US009703311B2

(12) United States Patent
Bäurle et al.

(10) Patent No.: US 9,703,311 B2
(45) Date of Patent: Jul. 11, 2017

(54) PROGRAMMING IN A POWER CONVERSION SYSTEM WITH A REFERENCE PIN

(71) Applicant: Power Integrations, Inc., San Jose, CA (US)

(72) Inventors: Stefan Bäurle, San Jose, CA (US); Edward E. Deng, Los Altos, CA (US)

(73) Assignee: Power Integrations, Inc., San Jose, CA (US)

( * ) Notice: Subject to any disclaimer, the term of this patent is extended or adjusted under 35 U.S.C. 154(b) by 20 days.

(21) Appl. No.: 14/661,827

(22) Filed: Mar. 18, 2015

(65) Prior Publication Data

US 2016/0274618 A1 Sep. 22, 2016

(51) Int. Cl.
*G05F 1/575* (2006.01)
*G05F 5/00* (2006.01)

(52) U.S. Cl.
CPC ..... *G05F 5/00* (2013.01)

(58) Field of Classification Search
CPC . G05F 3/262; G05F 1/565; G05F 3/30; G05F 3/245
USPC ..... 323/271, 273, 299, 311–316, 269; 327/541, 543, 589, 198
See application file for complete search history.

(56) References Cited

U.S. PATENT DOCUMENTS 6,188,211 B1 * 2/2001 Rincon-Mora ..... G05F 1/575 323/273
6,690,147 B2 * 2/2004 Bonto ..... G05F 1/575 323/273
7,385,453 B2 * 6/2008 Nervegna ..... H03K 3/011 331/111
7,405,546 B2 * 7/2008 Amrani ..... G05F 1/565 323/273
8,680,840 B2 * 3/2014 Iacob ..... G05F 3/242 323/311
2012/0320640 A1 * 12/2012 Baurle ..... H02M 3/33507 363/21.17

* cited by examiner

*Primary Examiner* — Rajnikant Patel
(74) *Attorney, Agent, or Firm* — Christensen O'Connor Johnson Kindness PLLC

(57) ABSTRACT

An interface module for use in a power conversion system includes a first current circuit coupled to a single external programming terminal to conduct a programming current through an external programming circuitry coupled to the single external programming terminal. A current comparator is coupled to the first current circuit to compare a current representative of the programming current with an internal current. A mode select circuit is coupled to the current comparator to generate a select signal to select one of a plurality of modes in response to a comparison of the current representative of the programming current with the internal current by the current comparator. A second current circuit is coupled to the first current circuit and the mode select circuit to generate a reference current in response to the programming current and the select signal from the mode select circuit.

21 Claims, 4 Drawing Sheets

PROGRAMMING IN A POWER CONVERSION SYSTEM WITH A REFERENCE PIN

BACKGROUND INFORMATION

Field of the Disclosure

The present invention relates generally to power conversion systems, and in particular but not exclusively, relates to an interface circuit including a reference pin for use in a power conversion system.

Background

Operation of a power conversion systems is usually controlled by a controller that may be designed as an integrated circuit module with pins or terminals coupled to sense data received from inputs and outputs of the power conversion system. The controllers generate control signals for the active elements/components of the power conversion systems to regulate the output in response to the data sensed through the pins or terminals. A common example of a power conversion system may include a switched mode power converter, and can be used in a wide variety of applications such as battery chargers or household appliances.

The cost of the controllers that are used to generate control signals for the power conversion systems can vary as a function of the complexity of the control circuitry, the semiconductor area required for the internal circuits of the controller, as well as the number of pins or terminals that are utilized by the controllers. In general, as additional functions for controllers for power conversion systems are added, corresponding additional pins or terminals are added to the integrated circuit module of the controller. As a consequence, each additional function that is added to a power converter controller generally translates into an additional pin on the power converter controller chip, which translates into increased costs and additional external components. Another consequence of providing additional functionality to a power converter controller is that sometimes there is often a substantial increase in power consumption of the controller as the number of functions of the power convert controller increases.

Flexibility in defining multiple modes of operation by an end customer is an asset in power converter controller integrated circuits. Different modes of operation in some applications may include output voltage range, frequency of operation, or any other adjustable feature of the controller. Mode selection by the end customer is usually realized through selecting specific external circuitry or components coupled to a "mode define" terminal of the integrated circuit that requires adding an extra pin or terminal to the controller integrated circuit, which translates into extra cost.

In almost all analog controlled power converters, a precise reference current source is required for charging a timing capacitor in an oscillator circuit that is used for an internal clock and/or in the filter circuits included in the analog controlled power converters. A dedicated pin or terminal of the controller is usually assigned to provide precise reference trimming for a precise reference current that is utilized in all conditions of operation.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1A:
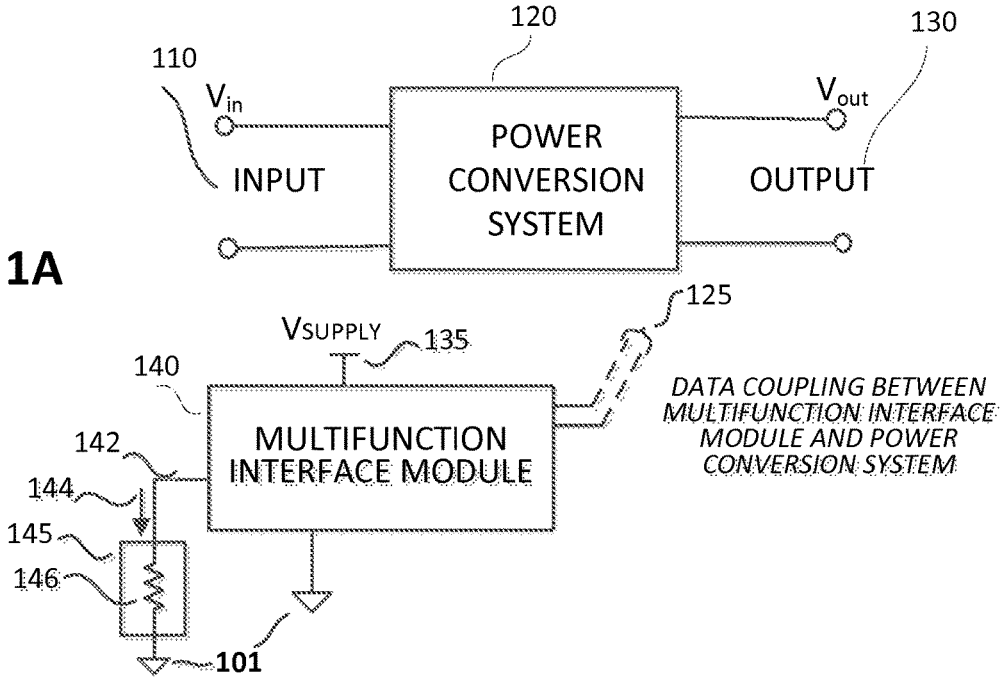
FIG. 1A is a block diagram illustrating generally one example of a multifunction interface module coupled through data lines to a power conversion system accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

In a wide variety of controllers for power converters, a precise oscillator is required for the timing circuitry. In an analog controller design, the precise oscillator is provided through a very accurate current source charging a timing capacitor. In an integrated circuit controller including a timing oscillator or other control blocks that require an accurate current source, the accurate precise current source is designed inside the integrated circuit. In some mixed signal controller integrated circuits the accurate precise current source could be achieved by adding trim bits to the controller that would consume more die area and would also increase the cost because of increased the final testing time.

To avoid the extra effort and cost of providing the trimming bits, an alternative analog design solution is to add a reference pin (R-pin) to the controller integrated circuit, which may produce a very accurate reference current by loading an internal band gap circuit having high accuracy (e.g., ±4% tolerance) with a precision resistor (e.g., ±1% tolerance). The resulting accurate current can then be mirrored and utilized for instance in timing circuitry of a clock oscillator, a filter circuit, or the like. However, this accurate precise reference current would be required continuously for the functionality of the integrated circuit, and the external reference pin would remain dedicated to generating the accurate reference current continuously throughout the operation of the circuit. Many system control applications require an option of operational mode detection, which is programmed by the customer through an external circuit or component coupled to an external pin. The integrated circuit pin is dedicated only to generate a precise reference current, and therefore limits the overall function set that could be implemented in a given product.

As will be discussed, methods and apparatuses for programming a power converter controller with an external programming terminal having multiple functions are disclosed. In one example, a power converter controller with a single external programming terminal having multiple functions is introduced. A user is allowed to program two or more different characteristics of the power converter controller using the same single external programming terminal. Furthermore, in one example, external programming circuitry that is coupled to the external programming terminal may be reutilized during normal operation of the power converter to generate the accurate reference current. In addition to the power consumption savings during normal operation, there is also a savings in space and size by reutilizing and sharing common circuit components for the two or more programmable functions of the power converter controller in accordance with the teachings of the present invention.

To illustrate, FIG. 1A is a block diagram 100 illustrating generally one example of a multifunction interface module 140 coupled through data lines 125 to a power conversion system 120 in accordance with the teachings of the present invention. In the example, multifunction interface module 140 includes multifunction interface circuitry that provides a precise reference current. As shown in the depicted example, multi function interface module 140 is coupled to a power conversion system block 120, which includes input terminals 110 coupled to an input voltage $V_{in}$ and generates an output voltage $V_{out}$ at output terminals 130. As an example, the input terminals 110 may be coupled to a direct current (DC) network or a low frequency (e.g., 50-60 Hz) alternating current (AC) network. The output terminals 130 may be coupled to any electrical or mechanical load. The reference ground at the input and reference ground at the output could be at different levels. The power conversion system block 120 in one example could be a power converter, such as a switch mode power converter, which may include a controller to regulate the output voltage $V_{out}$.

As shown in the depicted example, multifunction interface module 140 may be coupled through its data lines 125 to the power conversion system block 120 to communicate data with the system in accordance with the teachings of the present invention. The multi function interface module 140 receives a supply voltage $V_{supply}$ coupled to terminal 135 and has a reference ground 101. The multifunction interface module 140 could be interfaced either at the input referenced to the input ground, at the output referenced to the output ground, or included in the controller unit of the power conversion system block 120 and referenced to the controller ground.

In one example, multifunction interface module 140 includes a single external programming terminal 142, through which multiple functions of the power conversion system block 120 may be programmed in accordance with the teachings of the present invention. In the example, the single external programming terminal 142 is coupled to an external programming circuit 145 through which a programming current 144 is conducted. In one example, the external programming circuit 145 includes a single component, such as a resistor 146 having one or more different resistance values that can be selected to provide different programming information in accordance with the teachings of the present invention.

Figure 1B:
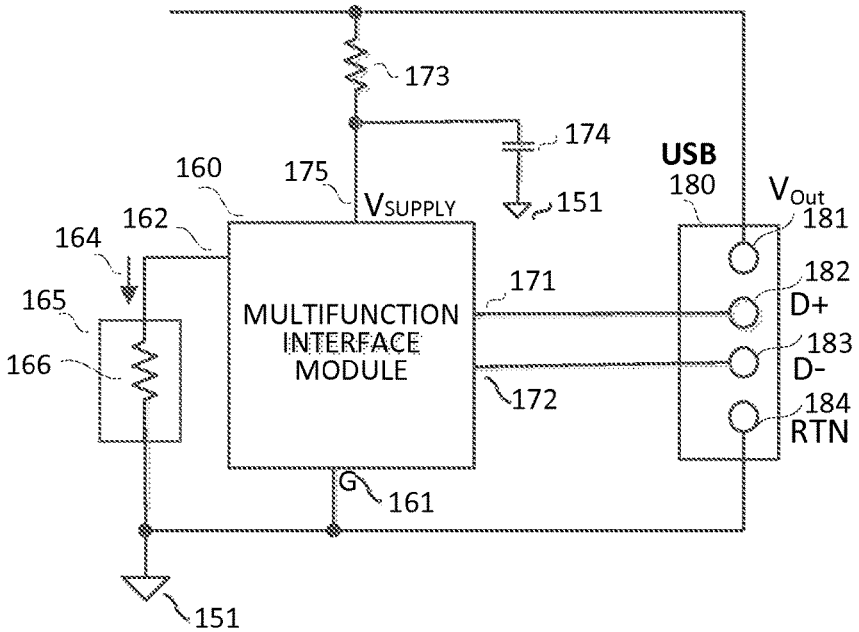
FIG. 1B is a block diagram illustrating generally another example of a multifunction interface module for use with a power conversion system, and coupled to a USB port in accordance with the teachings of the present invention.

FIG. 1B is a block diagram 150 illustrating generally another example of a multifunction interface module 160 for use with a power conversion system, and coupled to a USB port 180 in accordance with the teachings of the present invention. In the example, multifunction interface module 160 includes multifunction interface circuitry that provides a precise reference current. In one example, USB port 180 includes data terminals D+ 182 and D− 183, which are coupled to communication terminals 171 and 172 of multifunction interface module 160. In the example, multifunction interface module 160 includes a terminal 175 coupled to receive a supply voltage $V_{supply}$ coupled to be provided from a $V_{out}$ terminal 181 of the of the USB port 180 through a coupling resistor 173 across a filter capacitor 174 as shown.

In one example, multifunction interface module 160 includes a single external programming terminal 162 that is coupled to an external programming circuit 165, which in one example could include a single component such as a resistor 166 having one or more different resistance values that can be selected to provide different programming information in accordance with the teachings of the present invention. In one example, a programming current 164 is conducted through the external programming circuitry 165, and is utilized to program multiple functions of the system. The multifunction interface module 160 may communicate to the USB port 180 through the terminals 171 and 172, which are coupled to the data terminals D+ 182 and D− 183 of the USB port 180 in accordance with the teachings of the present invention. In one example, the ground reference G 161 of multifunction interface module 160 is coupled to the ground reference 151 of the external programming circuitry 165, which is coupled to the return connect RTN 184 of the USB port 180.

Figure 2:
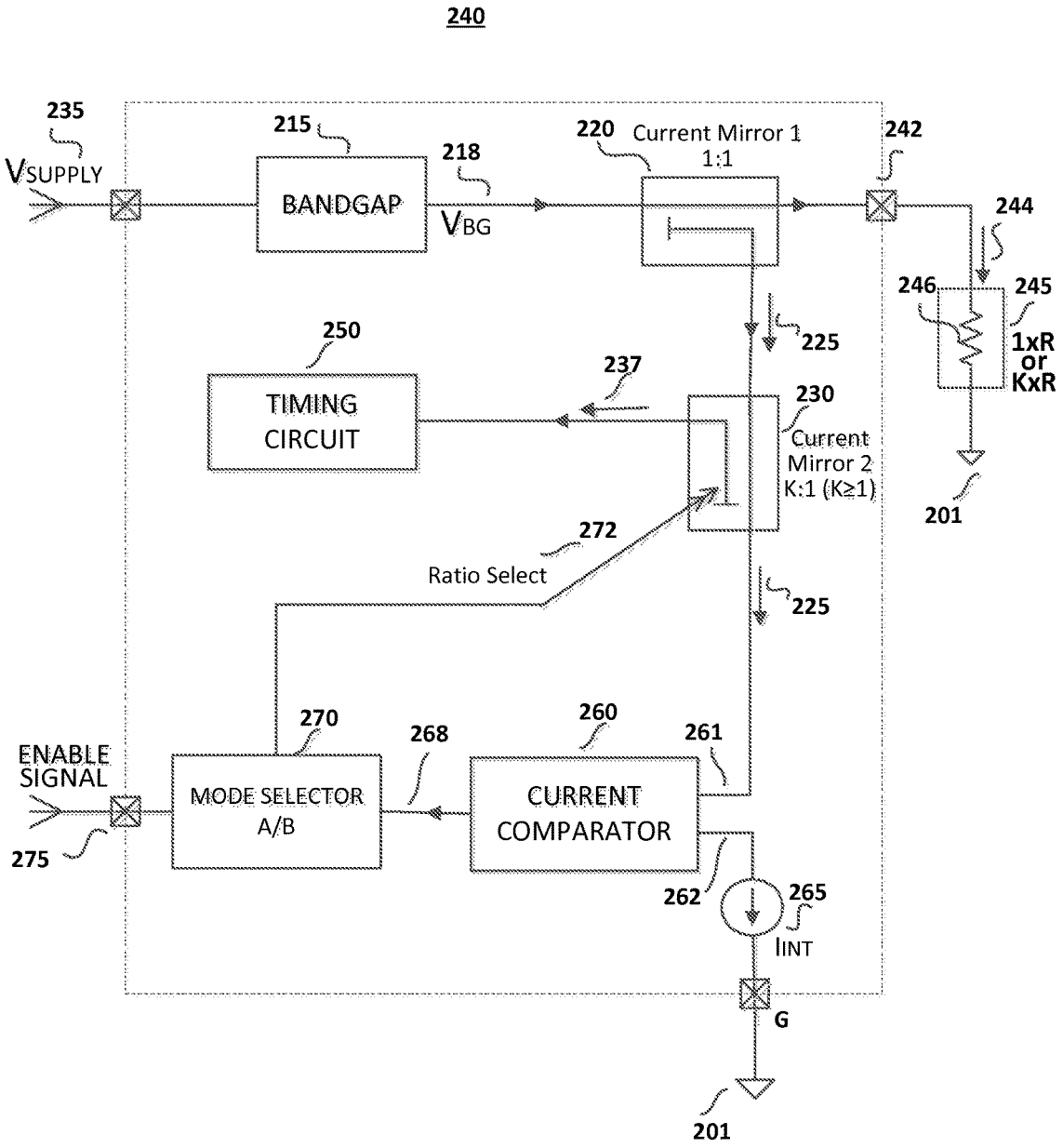
FIG. 2 is a block diagram illustrating internal blocks of an example of a multifunction interface module in accordance with teachings of the present invention.

FIG. 2 is a block diagram illustrating internal blocks of an example of a multi function interface module 240 for use in a power conversion system in accordance with teachings of the present invention. In one example, multi function interface module 240 is adapted to provide multifunction programming through a single external programming terminal 242, as well as generate a precise reference current 237 in accordance with the teachings of the present invention. As illustrated in the depicted example, a supply voltage $V_{supply}$ is coupled to be received at terminal 235 in reference to ground G 201. In one example, external programming circuitry 245 is coupled to single external programming terminal 242 through which a programming current 244 is conducted. In the example depicted in FIG. 2, external programming circuitry 245 is illustrated as a simple programming resistor component 246, which can have selected resistance values such as 1×R or K×R, where K is a constant multiplying coefficient. In one example, multiplying coefficient K=3 and R=12.4 kΩ, such that K*R=38.4 kΩ. In the example, a user may select the resistance value for resistor component 246 to program a specific function that defines a parameter or mode of operation, such as example an output voltage range of the power conversion system in accordance with the teachings of the present invention.

In particular, as shown in the depicted example, a bandgap block 215 is coupled to receive the supply voltage $V_{supply}$ from terminal 235 to generate an accurate bandgap voltage $V_{BG}$ 218 that is applied to programming terminal 242. As shown in the depicted example, the external programming circuit 245, which in one example includes programming resistor 246, is coupled to programming terminal 242 to receive the accurate bandgap voltage $V_{BG}$ 218. In the example, the programming resistor 246 of programming circuit 245 has a tight tolerance such that the accurate programming current 244 is conducted through programming resistor 246.

In the example, the accurate programming current 244 passes through a first current mirror 220, which is mirrored to pass a current 225, which is substantially equal to programming current 244, through a second current mirror 230. In the example, first current mirror 220 has a 1:1 current mirror ratio such that mirrored current 225 is substantially equal to or representative of the programming current 244. In one example, second current mirror 230 has an adjustable ratio, which may be selected to be K:1, where K≥1. In the example, a current comparator 260 is coupled to receive the current 225 on its first input terminal 261, and compares current 225 to an internal current source $I_{INT}$ 265 coupled to second input terminal 262 of current comparator 260. In the depicted example, the internal current source $I_{INT}$ 265 is coupled to sink current to ground G 201. In one example, it is appreciated that the internal current source $I_{INT}$ 265 does not necessarily need to be an accurate high cost current source, and a lower cost unregulated current source may be sufficient.

In the depicted example, the current 225 received on terminal 261 of comparator 260 is a function or mode/parameter select current. Depending on the resistance value selected for programming resistor 246 of programming circuit 245, current 225 may have a value of either $V_{BG}$/1×R or $V_{BG}$/K×R. In response to comparing current 225 to the internal unregulated current source 265, the current comparator 260 generates a signal 268, which may be a logic high or a logic low.

In the example, mode selector block 270 is coupled to receive the signal 268 to select a parameter or mode of operation of a power conversion system in response to the signal 268. In one example, an enable or activation signal is coupled to be received at terminal 275 to enable mode selector block 270 to select a mode of operation. In one example, the enable or activation signal received at terminal 275 is enabled during startup or power up to select between two modes/parameters of operation, which in one example is either mode A or mode B. In one example, modes A and B may correspond to two different ranges of a power converter output voltages, such as for example 5-12 VDC or 5-20 VDC. Thus, in the example, mode selector block 270 generates a ratio select signal 272 to select between modes A and B in response to signal 268 in accordance with the teachings of the present invention. In another example, it is appreciated that there may be more than two modes to select, and that signal 268 may have more than two different values for mode selector block 270 to select from when generating ratio select signal 272 in accordance with the teachings of the present invention.

In one example, the ratio select signal 272 from mode selector block 270 is coupled to be received by second current mirror 230 to control the ratio selection of the second current mirror 230, which in one example is K:1, where K≥1.

In the example, second current mirror 230 generates a mirrored current 237 of current 225 having the selected ratio K:1, where K≥1, in response to ratio select signal 272. In the example, the mirrored current 237 is coupled to be received by a timing circuit 250. In the example, mirrored current 237 is an accurate precise current and therefore is a fixed accurate precise reference current. In one example, timing circuit 250 may utilize mirrored current 237 to accurately and precisely generate timing information for the power conversion system, which may be achieved for example by charging a timing capacitor of an internal oscillator, clock, or the like.

In the example, it is appreciated that even if there is a change in programming current 244, which occurs in response to a change in the selection of a mode of operation due to a change in the resistance value of resistor 246 of programming circuit 245, the second current mirror 230 ratio is also changed accordingly at startup to offset (compensate) the change in programming current 244 and maintain current 237 at the precise unchanged value. In other words, in one example, the current 237 remains constant or unchanged for each of the plurality of modes of operation that may be selected. For instance, when the resistance value of programming resistor 246 is changed from 1×R to K×R, programming current 244 changes from $V_{BG}$/1×R to $V_{BG}$/K×R. However, at the same time, when the ratio select signal 272 from mode selector block 270 changes from mode A to mode B, and the selected ratio of second current mirror 230 simultaneously changes by a factor of K from 1:1 to K:1, which offsets (compensates) the change in programming current 244, and maintains the precise reference current 237 at unchanged value for the timing circuit 250, whether programming resistor 246 is 1×R or K×R in accordance with the teachings of the present invention. In other words, the precise reference current 237 remains constant or unchanged whether mode A or mode B is selected in accordance with the teachings of the present invention. Thus, it is appreciated that multifunction interface module 240 not only enables programming of mode A or mode B, but multifunction interface module 240 also provides the precise reference current 237, which can used by timing circuit 250 whether mode A or mode B is selected in accordance with the teachings of the present invention.

Figure 3:
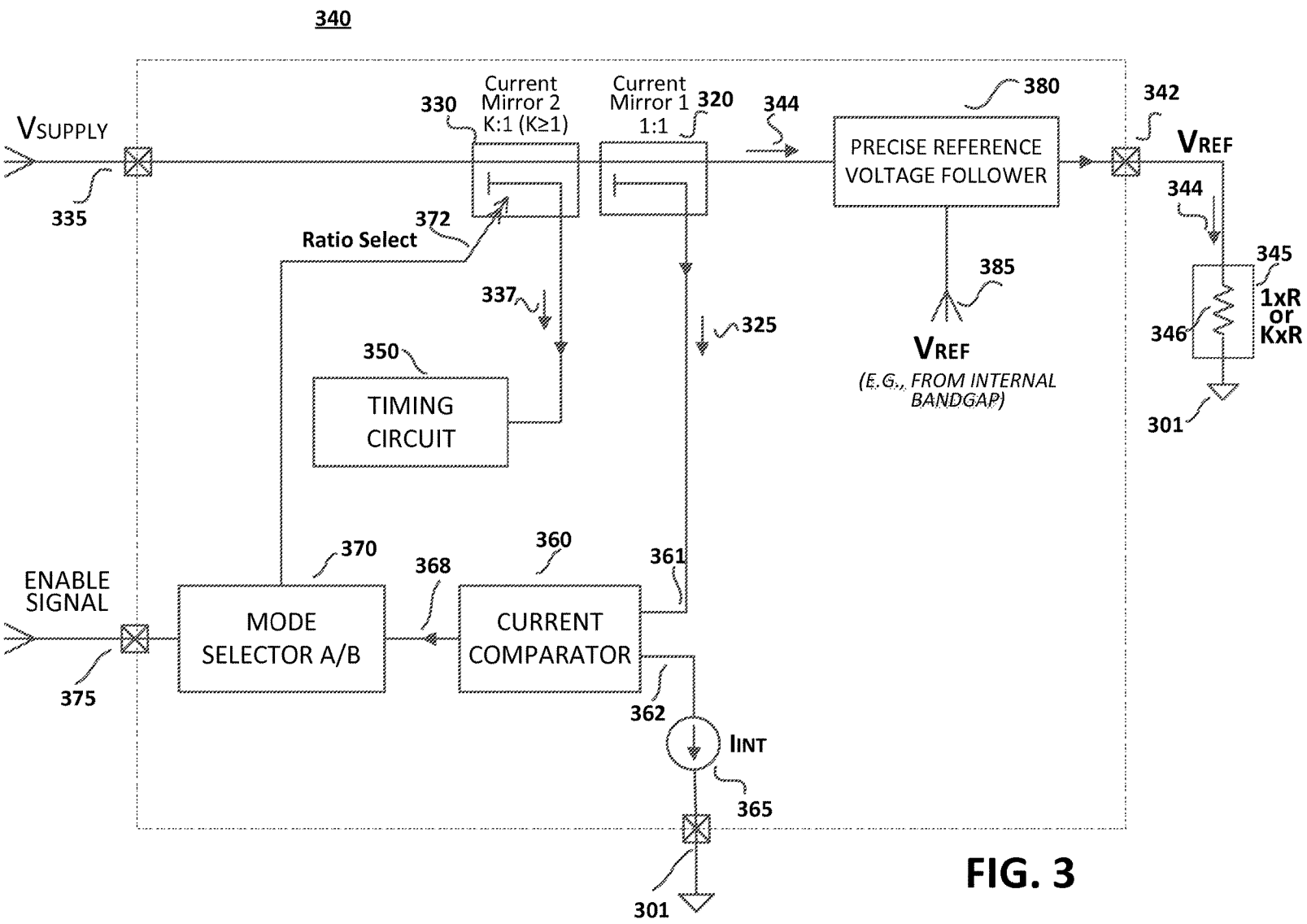
FIG. 3 is a block diagram illustrating internal blocks of another example of a multifunction interface module in accordance with teachings of the present invention.

FIG. 3 is a block diagram illustrating internal blocks of another example of a multifunction interface module 340 in accordance with teachings of the present invention. In one example, multi function interface module 340 is adapted to provide multifunction programming through a single external programming terminal 342 as well as generate a precise reference current 337 in accordance with the teachings of the present invention. As shown in the depicted example, a supply voltage $V_{supply}$ is coupled to be received at terminal 335 in reference to ground G 301. Similar to the example depicted in FIG. 2, external programming circuitry 345 in FIG. 3 is coupled to single external programming terminal 342. In the depicted example, external programming circuitry 345 includes a simple programming resistor component 346, which in one example may have a user selected resistance value of either 1×R or K×R. In one example, the user selected resistance value has a tight tolerance (e.g., ±1%) where K is a constant multiplying coefficient. In one example K=3, R=12.4 kΩ, and K*R=37.4 Ωk (nearest standard value). As shown in the example, a current 344 is conducted through programming resistor component 346 of programming circuitry 345. In the example, the selected external programming circuit 345 and programming resistor component 346 coupled to single external programming terminal 342 may be selected by the user to control current 344 to program a specific function or parameter, or program a specific mode of operation of a power conversion system in accordance with the teachings of the present invention.

In the depicted example, a current mirror 1, 320, a current mirror 2, 330, and a precise reference voltage follower 380 are coupled to terminal 335 to receive the supply voltage $V_{supply}$. As shown in the example depicted in FIG. 3, current 344 is conducted through current mirror 1, 320, current mirror 2, 330, and precise reference voltage follower 380. In the example, the first current mirror (current mirror 1, 320) has a ratio of 1:1 to generate a reflected current 325 that has the same value as current 344, which passes through the user selected external programming circuit 345 including programming resistor 346. The second current mirror (current mirror 2, 330) has a ratio of K:1, which has a coefficient K≥1 that is selected in response to a ratio select signal 372, to generate a precise reflected current 337. In one example, precise reflected current 337 is coupled to be received by the timing circuit 350 to charge an internal timing capacitor for an internal clock oscillator.

As shown in the depicted example, precise reference voltage follower 380 is coupled to single external programming terminal 342. In one example, precise reference voltage follower 380 is coupled to generate a precise voltage at single external programming terminal 342 that follows a tight value of a reference voltage $V_{REF}$ 385 coupled to be received by precise reference voltage follower 380. For instance, in one example, precise reference voltage follower 380 is coupled to receive reference voltage $V_{REF}$ 385 from an internal bandgap circuit. In one example, the precise value of the voltage on single external programming terminal 342 remains tight or substantially equal to the reference voltage $V_{REF}$ 385, regardless of any change in current 344 that may happen through the user selected external programming circuit 345 and programming resistor 346.

In the example, current 344 may change based on the user selected resistance value of programming resistor 346 of external programming circuit 345 from $V_{REF}$/1×R to $V_{REF}$/K×R. In one example, the second current mirror (current mirror 2, 330) has a selectively adjustable current ratio of K:1, where K≥1. In one example, the adjustable current ratio of K:1 can be implemented by adjusting the total silicon area and size of a device included in second current mirror (current mirror 2, 330) to realize a desired ratio K:1. For instance, the total silicon area and size of the device in second current mirror (current mirror 2, 330), and therefore the current mirror ratio, may be adjusted by selectively coupling one or more of a plurality of transistors or devices in parallel in response to a ratio select signal 372 generated by mode selector block 370 in response to signal 368 from current comparator 360.

As shown in the example of FIG. 3, the mirrored current 325 generated from first current mirror (current mirror 1, 320) with a 1:1 ratio is received at the first terminal 361 of the current comparator 360. Current 325 follows changes in current 344 in response to the user selected programming resistor 346 of external programming circuit 345. Current comparator 360 compares current 325 received at its first terminal 361 with the current at its second terminal 362, which is coupled to the internal unregulated current source $I_{INT}$ 365 that is coupled to ground 301. In one example, a low cost unregulated current source is utilized to provide the comparison current. Current comparator 360 is coupled to generate signal 368 having an output value of logic high or logic low, which is generated in response to the comparison of current 325 with the internal unregulated current source $I_{INT}$ 365.

In the example illustrated in FIG. 3, an enable signal or activation signal is coupled to be received by mode selector block 370 at terminal 375. In one example, the enable signal received at terminal 375 indicates a startup or power-up condition in the power conversion system. In the example, mode selector block 370 is enabled to select a parameter or a mode (e.g., mode A or mode B) during startup in response to receiving the enable signal at terminal 375. In particular, the mode selector block 370 is activated upon receiving the enable signal at terminal 375 to control ratio select signal 372 to select modes of operation in accordance with the teachings of the present invention. In the simplified example illustrated in FIG. 3, ratio select signal 372 selecting mode A corresponds to selecting a ratio of 1:1 for current mirror 2, 330, and ratio select signal 372 selecting mode B corresponds to selecting a ratio of K:1 for current mirror 2, 330. In one example, K=3.

In one example, current mirror 2, 330 generates a mirrored current 337 having the selected ratio in response to ratio select signal 372. In the example, the mirrored current 337 is coupled to be received by a timing circuit 350. In the example, mirrored current 337 is an accurate precise current and therefore is a fixed accurate precise reference current. In one example, timing circuit 350 may utilize mirrored current 337 to accurately and precisely charge an internal timing capacitor of an internal oscillator, clock, or the like.

In the example, it is appreciated that even when there is a change in current 344, which occurs for example when the resistance value of programming resistor 346 is changed from K×R (mode A) to 1×R (mode B), current 344 changes from $V_{REF}$/K×R (mode A) to $V_{REF}$/1×R (mode B). However, at the same time, when the ratio select signal 372 from mode selector block 370 changes from mode A to mode B, and the selected ratio of second current mirror 330 simultaneously changes by a factor of K from 1:1 to K:1, which offsets the change in current 344, and maintains the precise reference current 337 at an unchanged value for the timing circuit 350 whether programming resistor 346 is 1×R or K×R in accordance with the teachings of the present invention. In other words, the precise reference current 337 remains unchanged whether mode A or mode B is selected in accordance with the teachings of the present invention. In one example, the precise reference current 337 is coupled to be received by timing circuit 350 to charge an internal timing capacitor of an internal oscillator/clock. Thus, it is appreciated that multifunction interface module 340 not only enables programming of mode A or mode B, but multifunction interface module 340 also provides the precise reference current 337, which can be used by timing circuit 350 whether mode A or mode B is selected in accordance with the teachings of the present invention.

Figure 4:
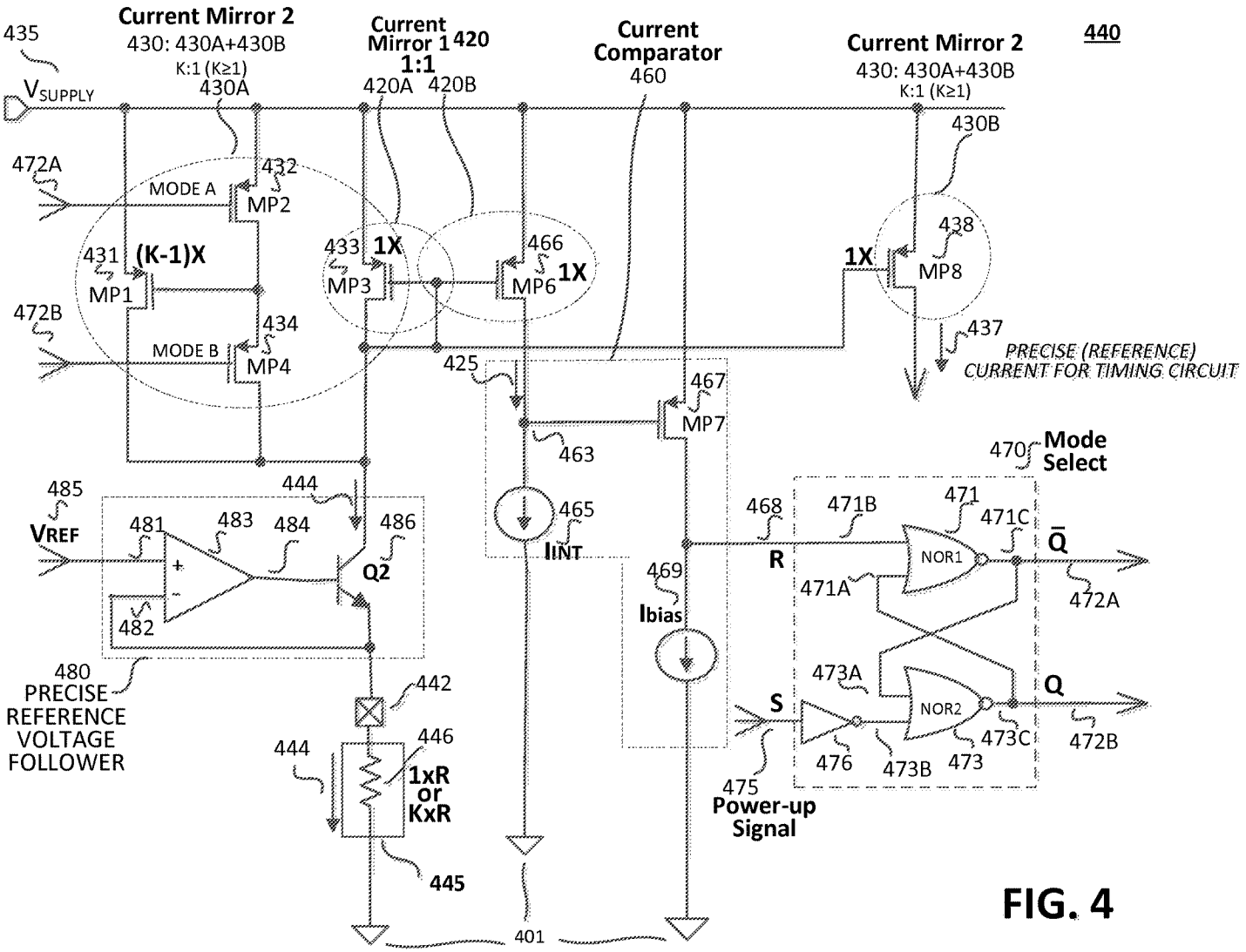
FIG. 4 is a schematic illustrating an example of a multifunction interface module in accordance with teachings of the present invention.

FIG. 4 is a schematic illustrating an example of a multifunction interface module 440 in accordance with teachings of the present invention. In one example, multifunction interface module 440 in FIG. 4 is one example implantation of multifunction interface module 340 illustrated in FIG. 3. In the depicted example, multifunction interface module 440 includes a current mirror 1 420, which is illustrated in FIG. 4 as including portion 420A and portion 420B. In the example, portion 420A includes PMOS transistor MP3 433, and portion B includes PMOS transistor MP6 466. Multifunction interface module 440 also includes a current mirror 2 430, which is illustrated in FIG. 4 as including portion 430A and portion 430B. In the example, portion 430A includes PMOS transistor MP1 431, PMOS transistor MP2 432, PMOS transistor MP3 433, and PMOS transistor MP4 434, while portion 430B includes PMOS transistor MP8 438.

As shown in the example depicted in FIG. 4, a supply voltage $V_{supply}$ received at terminal 435 is applied to a PMOS transistor MP3 433. In the depicted example, transistor MP3 433 is diode connected to mirror or reflect current that is conducted through transistor MP3 433 to the other devices that are coupled to it, such as transistor MP6 466 of portion 420B of current mirror 1 420, and transistor MP8 438 of portion 430B of current mirror 2 430 as shown. In the depicted example, the current that is mirrored or reflected by the diode connected PMOS transistor MP3 433 can selectively be adjusted up to K times more by selectively coupling or de-coupling a second device in parallel that is coupled in parallel with PMOS transistor MP3 433. For example, PMOS transistor MP1 431 of portion 430A of current mirror 2 430 may be selectively coupled or de-coupled in parallel with PMOS transistor MP3 433 in response to signals 472A and 472B. PMOS transistor MP1 431 has a size and current capacity (K−1) times more than PMOS transistor MP3 433. Thus, the total combined size and current capacity of a parallel combination of PMOS transistor MP3 433 and PMOS transistor MP1 431 results in a current mirror ratio of K times more than PMOS transistor MP3 433. In one example, K=3 and K−1=2.

Activation and deactivation of the ratio scale transistor MP1 431 in current mirror 2 430 is through the pull up of the gate of transistor MP1 431 through transistor MP2 432 to turn off transistor MP1 431, or through the pull down of the gate of transistor MP1 431 through transistor MP4 434 to turn on transistor MP1 431. In the depicted example, by turning off transistor MP1 431 through transistor MP2 432, mode A is selected and the ratio of current mirror 2 430 is 1:1. By turning on transistor MP1 431 through transistor MP4 434, mode B is selected and the ratio of current mirror 2 430 is K:1, where K>1.

Activation signals 472A and 472B for the gate pull up and pull down through transistors MP2 432 and MP4 434, respectively, are generated by the mode select block 470. In the depicted example, mode select block 470 is implemented with a latch or flip-flop. In the example of FIG. 4, an SR latch is shown that includes two cross-coupled NOR gates 471 and 473, which latch after activation. As shown, the two NOR gates 471 and 473 are cross-coupled so that first input 471A of NOR1 gate 471 is coupled to output 473C of NOR2 gate 473, and first input 473A of NOR2 gate 473 is coupled to the output 471C of the NOR1 gate 471. Second input 473B of NOR2 gate 473 receives an enable signal or a power-up signal at set terminal S 475 of mode select block through inverter 476 from the power-up circuitry during power-up. It is appreciated that in other examples, the set signal may be received from any other suitable function block of the power conversion system in accordance with the teachings of the present invention. The reset signal 468 on the reset terminal R 468 of the mode select block 470 is received from the current comparator block 460. In the depicted example, current comparator block 460 includes node 463, PMOS transistor MP7 467, and bias current source $I_{bias}$ 469 as shown. In one example, a logic low first output signal $Q^{bar}$ 472A, for mode A selection, and a logic low second output signal Q 472B for mode B selection are output from the mode select block 470, and are coupled to be received by PMOS transistor MP2 432 and PMOS transistor MP4 434, respectively, to select the ratio (e.g., 1:1 or K:1) for current mirror 2 430 in accordance with the teachings of the present invention. Thus, the first output signal $Q^{bar}$ 472A and the second output signal Q 472B of the mode select circuit 470 may be considered as the select signal output of the mode select circuit 470 that are used to select the current mirror ratio of current mirror 2 430 in accordance with the teachings of the present invention.

In the example shown in FIG. 4, current mirror 1 420 has a mirror ratio of 1:1. As mentioned previously, current mirror 1 420 includes portion 420A, which includes diode connected PMOS transistor MP3 433, having a size of 1×, and portion 420B, which includes PMOS transistor MP6 466, also having size of 1×. In the example, current mirror 2 430 has a selectable mirror ratio of 1:1 or K:1, where K≥1, and includes portion 430B having transistor MP8 438, having a size of 1×, and portion 430A having an adjustable size implemented with a selectable parallel combination of transistor MP3 433, having a size of 1×, and transistor MP1 431, having a size of (K−1)x. The command for activating the parallel connection of transistor MP1 431 is received from mode select block 470 through signal 472A and signal 472B. As mentioned, signal 472A and signal 472B activate either pull up transistors MP2 432 to turn off MP1 431, or gate pull down transistor MP4 434 to turn on MP1 431.

The current 444 from supply voltage $V_{supply}$ through the portion 430A of current mirror 2 430 and through a precise reference voltage follower block 480 is passed to a single external programming terminal 442 of multifunction interface module 440. In one example, precise reference voltage follower block 480 is coupled to receive a reference voltage $V_{REF}$ 485 to set the voltage at external programming terminal 442 to $V_{REF}$. An external programming circuit 445, which includes a user selected programming resistor 446, is coupled to a single external programming terminal 442 to receive reference voltage $V_{REF}$ and conduct current 444. In one example current 444 is based on the user selected programming resistor 446, which has a user selected resistance value of either 1×R or K×R. As such, current 444 could be either $V_{REF}/(1\times R)$ or $V_{REF}/(K\times R)$, which may be used to select current mirror 2 430A ratio of 1:1 or K:1. In other examples, it is appreciated that the programming resistor 446 could be selected from more than two options to select more than two different ratios for current mirror 2 430 in accordance with the teachings of the present invention.

As shown in the depicted example, precise reference voltage follower block 480 includes of an operational amplifier 483 having a non-inverting input 481 that is coupled to receive precise reference voltage $V_{REF}$ 485. The inverting input 482 of operational amplifier 483 is coupled to receive the voltage on single external programming terminal 442 to keep the voltage on single external programming terminal 442 virtually equal to the precise voltage reference $V_{REF}$ 485 received at the non-inverting input 481 of operational amplifier 483. Output 484 of the operational amplifier 483 is coupled to be received by the base of a bipolar transistor 486, which conducts current 444 that passes from the supply voltage $V_{supply}$ terminal 435 through portion 430A of current mirror 2 430 to the user selected programming resistor 446 of external programming circuitry 445 coupled to single external programming terminal 442 in accordance with the teachings of the present invention.

Current mirror 1 420 with a 1:1 ratio mirrors any current changes in current 444 due to the user selected programming resistor 446 to mirrored current 425, which is conducted through transistor MP6 466 to node 463 of current comparator 460. Current comparator 460 compares mirrored current 425 from PMOS transistor MP6 466 with an internal unregulated current source $I_{INT}$ 465.

If the mirrored current 425 through transistor MP6 466 is greater than the current of current source $I_{INT}$ 465, current $I_{INT}$ 465 is sinked to ground 401, and the gate 463 of PMOS transistor MP7 467 is pulled high and therefore MP7 467 remains off. As a result, terminal R of the mode select block 470, which is coupled to the first input 471B of NOR1 gate 471 is pulled low. The second input 471A of NOR1 gate 471, which is received from the output 473C of NOR2 gate 473 is also low, and the signal $Q^{bar}$ 472A at the output 471C of NOR1 gate 471 goes high, which in turn latches the signal Q 472B at the output 473C of NOR2 gate 473 at low. As a result, with the signal $Q^{bar}$ 472A latched high and the signal Q 472B latched low, PMOS transistor MP2 432 is turned off, and PMOS transistor MP4 434 is turned on. With PMOS transistor MP4 434 turned on, the gate of PMOS transistor MP1 431 is pulled down, which turns on PMOS transistor MP1 431 in parallel with PMOS transistor MP3 433, mode B is selected and the ratio of second current mirror (current mirror 2 430) is therefore K:1 because the combined current flow in current 444 of PMOS transistor MP1 431 and PMOS transistor MP3 433 is K times greater than the current flow of just PMOS transistor MP3 433. The current 444 is then mirrored through PMOS transistor MP8 438 to generate a current 437. In one example, current 437 is a precise current that may be received by timing circuit as a precise reference current to generate an accurate oscillating signal or clock signal in accordance with the teachings of the present invention. In one example, it is appreciated that increased current ratio for current mirror 2 430 offsets (compensates) for the increased current 444 through programming resistor 446 due to a K times lower resistance value selected for programming resistor 446, and that the precise reference current 437 received by the timing circuit, to for example charge a timing capacitor for internal clock oscillator, remains precisely fixed in accordance with the teachings of the present invention.

If the mirrored current 425 through transistor MP6 466 is less than the current of current source $I_{INT}$ 465, (in one example the mirrored current 425 could be either 30 uA or 10 uA compared to current source 465 $I_{INT}$=20 uA), the gate of PMOS transistor MP7 467 is pulled low through current source $I_{INT}$ 465, and PMOS transistor MP7 467 turns on to sink current $I_{bias}$ 469 to ground. P-channel transistor MP7 467 therefore pulls up terminal R 468 of the mode select block 470 to high. This results in the signal $Q^{bar}$ 472A at the output 471C of NOR1 gate 471 to go low, which in turn latches the signal Q 472B at the output 473C of NOR2 gate 473 at high. As a result, with the signal $Q^{bar}$ 472A latched low and the signal Q 472B latched high, PMOS transistor MP2 432 is turned on, and PMOS transistor MP4 434 is turned off. With PMOS transistor MP2 432 turned on, the gate of PMOS transistor MP1 431 is pulled up, which turns off PMOS transistor MP1 431. As a result, mode A is selected and the ratio of second current mirror 2 430 is therefore 1:1 because all of current 444 is conducted through PMOS transistor MP3 433 since PMOS transistor MP1 431 is turned off.

In one numerical example K=3, R=12.4 kΩ, the current through transistor MP6 466 is 30 uA, K×R=38.3 kΩ, the current in transistor MP6 466 is 10 uA), and $I_{INT}$=20 uA, where $I_{INT}$ 465 is not required to be an expensive precise regulated current source. In an example application in which multifunction interface module 440 is included with a power conversion system, used for example in a cellphone charger, a 1×R selection results in a mode B selection that may define a charger output voltage range of 5-12 VDC, and user defined K×R selection results in a Mode A selection that may define an output voltage range of 5-20 VDC. In one example, the selected mode as indicated with signal $Q^{bar}$ 472A and signal Q 472B may be communicated to the power conversion system through for example data lines 125, as illustrated for example in FIG. 1A. In another example, the selected mode as indicated with signal $Q^{bar}$ 472A and signal Q 472B may be communicated to the power conversion system through for example data terminals D+ 182 and D− 183 of a USB port 180, as illustrated for example in FIG. 1B. It is appreciated of course that the examples of FIG. 1A and FIG. 1B are only two examples, and that the selected mode may be communicated to the power conversion system through other suitable communications in accordance with the teachings of the present invention. It is also noted that although the examples described above only select between two modes of either A or B for explanation purposes, and that in other examples, more than two different modes may be selected in accordance with the teachings of the present invention.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. An interface module for use in a power conversion system, comprising:

a first current circuit coupled to a single external programming terminal, wherein the first current circuit is coupled to conduct a programming current through an external programming circuitry coupled to the single external programming terminal, wherein the programming current is conducted through the external programming circuitry during normal operation of the power conversion system;

a current comparator coupled to the first current circuit to compare a current representative of the programming current with an internal current;

a mode select circuit coupled to the current comparator to generate a select signal to select one of a plurality of modes in response to a comparison of the current representative of the programming current with the internal current by the current comparator; and a second current circuit coupled to the first current circuit and the mode select circuit to generate a reference current in response to the programming current through the external programming circuitry during the normal operation of the power conversion system and the select signal from the mode select circuit.

2. The interface module of claim 1 wherein the reference current is a precise reference current coupled to be received by a timing circuit to generate power conversion system timing information.

3. The interface module of claim 1 wherein the second current circuit includes an adjustable current mirror circuit having a current mirror ratio that is coupled to be adjusted in response to the select signal.

4. The interface module of claim 3 wherein the adjustable current mirror circuit includes a plurality of devices coupled in parallel, wherein the current mirror ratio is coupled to be adjusted in response to the select signal by selectively coupling one or more of the plurality of devices in response to the select signal.

5. The interface module of claim 1 wherein the first current circuit includes a first current mirror circuit, wherein the first current mirror circuit is coupled to generate the current representative of the programming current in response to the programming current through the external programming circuitry.

6. The interface module of claim 1 wherein the current representative of the programming current is substantially equal to the programming current.

7. The interface module of claim 1 wherein the mode select circuit is coupled to receive an enable signal, wherein the mode select circuit is further coupled to generate the select signal in response to the enable signal.

8. The interface module of claim 7 wherein the mode select circuit includes a latch having a set terminal coupled to receive the enable signal through a set terminal of the latch, wherein the latch includes a reset terminal coupled to the current comparator, and wherein the select signal is generated through an output of the latch.

9. The interface module of claim 1 wherein the external programming circuitry coupled to the single external programming terminal is selectable between two or more values, each value selecting one of the plurality of modes.

10. The interface module of claim 9 wherein the external programming circuitry includes a resistor coupled to the single external programming terminal, wherein the programming current is to be conducted through the resistor.

11. The interface module of claim 1 further comprising a reference voltage follower circuit coupled to the single external programming terminal to provide a reference voltage at the single external programming terminal.

12. The interface module of claim 1 further comprising an internal unregulated current source coupled to generate the internal current coupled to the current comparator.

13. The interface module of claim 1 wherein the reference current remains unchanged for each of the plurality of modes that is selected by the mode select circuit.

14. A method for programming a circuit, comprising:

conducting a programming current through external programming circuitry coupled to a single external programming terminal, wherein the programming current is conducted through the external programming circuitry during normal operation of the power conversion system;

comparing a current representative of the programming current with an internal current;

selecting one of a plurality of modes of operation of a power conversion system in response to said comparing the current representative of the programming current with the internal current; and generating a reference current in response to the programming current through the external programming circuitry during the normal operation of the power conversion system and in response to said comparing the current representative of the programming current with the internal current.

15. The method of claim 14 further comprising generating power conversion system timing information in response to the reference current with a timing circuit coupled to receive the reference current.

16. The method of claim 14 wherein said generating the reference current comprises adjusting a current mirror ratio of an adjustable current mirror circuit in response to said comparing the current representative of the programming current with the internal current.

17. The method of claim 16 wherein said adjusting the current mirror ratio of the adjustable current mirror circuit comprises selectively coupling one or more of a plurality of devices included in the adjustable current mirror circuit in response to said comparing the current representative of the programming current with the internal current.

18. The method of claim 16 wherein said adjusting the current mirror ratio of the adjustable current mirror circuit maintains the reference current at an unchanged precise value for each of the plurality of modes that is selected by the mode select circuit.

19. The method of claim 14 further comprising mirroring the programming current with a first current mirror circuit to generate the current representative of the programming current, wherein the programming current is substantially equal to the current representative of the programming current.

20. The method of claim 14 further comprising latching a selected one of the plurality of modes in response to receiving an enable signal and said selecting one of the plurality of modes of operation of the power conversion.

21. The method of claim 14 further comprising selecting a resistance value of a resistor included in the external programming circuitry to set the programming current.

* * * * *